US008882948B2

(12) United States Patent
Hayashi et al.

(10) Patent No.: US 8,882,948 B2
(45) Date of Patent: Nov. 11, 2014

(54) GLOVE MANUFACTURING METHOD AND MANUFACTURING APPARATUS, AND GLOVE MANUFACTURED BY THE METHOD OR THE APPARATUS

(75) Inventors: Yutaka Hayashi, Nomi (JP); Yukio Yasuda, Nomi (JP); Akihisa Kaneda, Nomi (JP); Matteo Morlacchi, Legnano (IT)

(73) Assignee: OutDry Technologies Corporation, Portland, OR (US)

( * ) Notice: Subject to any disclaimer, the term of this patent is extended or adjusted under 35 U.S.C. 154(b) by 625 days.

(21) Appl. No.: 12/922,873

(22) PCT Filed: Mar. 25, 2009

(86) PCT No.: PCT/JP2009/055948

§ 371 (c)(1),
(2), (4) Date: Dec. 23, 2010

(87) PCT Pub. No.: WO2009/119663

PCT Pub. Date: Oct. 1, 2009

(65) Prior Publication Data

US 2011/0258750 A1 Oct. 27, 2011

(30) Foreign Application Priority Data

Mar. 25, 2008 (JP) ..... 2008-077740
Jul. 29, 2008 (WO) ..... PCT/JP2008/063578

(51) Int. Cl.
*B32B 37/00* (2006.01)
*A41D 19/04* (2006.01)

(52) U.S. Cl.
CPC ..... *A41D 19/04* (2013.01)
USPC ..... 156/156

(58) Field of Classification Search
USPC ..... 156/156, 285, 308.2
See application file for complete search history.

(56) References Cited

U.S. PATENT DOCUMENTS

| | | | | |
|---|---|---|---|---|
| 4,010,877 | A | 3/1977 | Hayes et al. | |
| 4,776,209 | A | 10/1988 | Patchel | |
| 7,645,353 | B2 | 1/2010 | Thomaschefsky et al. | |
| 7,803,438 | B2 * | 9/2010 | Flather et al. | 428/35.7 |

(Continued)

FOREIGN PATENT DOCUMENTS

| | | | |
|---|---|---|---|
| CN | 2426689 | Y | 4/2001 |
| FR | 2643713 | A1 * | 8/1990 |

(Continued)

OTHER PUBLICATIONS

Machine Translation of French Patent 2643713, Date Unknown.*

(Continued)

*Primary Examiner* — Jeff Aftergut
(74) *Attorney, Agent, or Firm* — Schwabe, Williamson & Wyatt, P.C.

(57) ABSTRACT

In a glove manufacturing device, a glove insert with thermoplastic adhesive applied on the outer side is fixed on a glove holding member in a state where it has been inserted into the inner side of the outer material of the glove. The glove insert is then expanded by way of a gas injection means, and the outer material of the glove and the glove insert are bonded. The glove holding member is fixed on the turntable and sent to a heating furnace by this rotating.

11 Claims, 8 Drawing Sheets

(56) References Cited

U.S. PATENT DOCUMENTS

Figure 1:
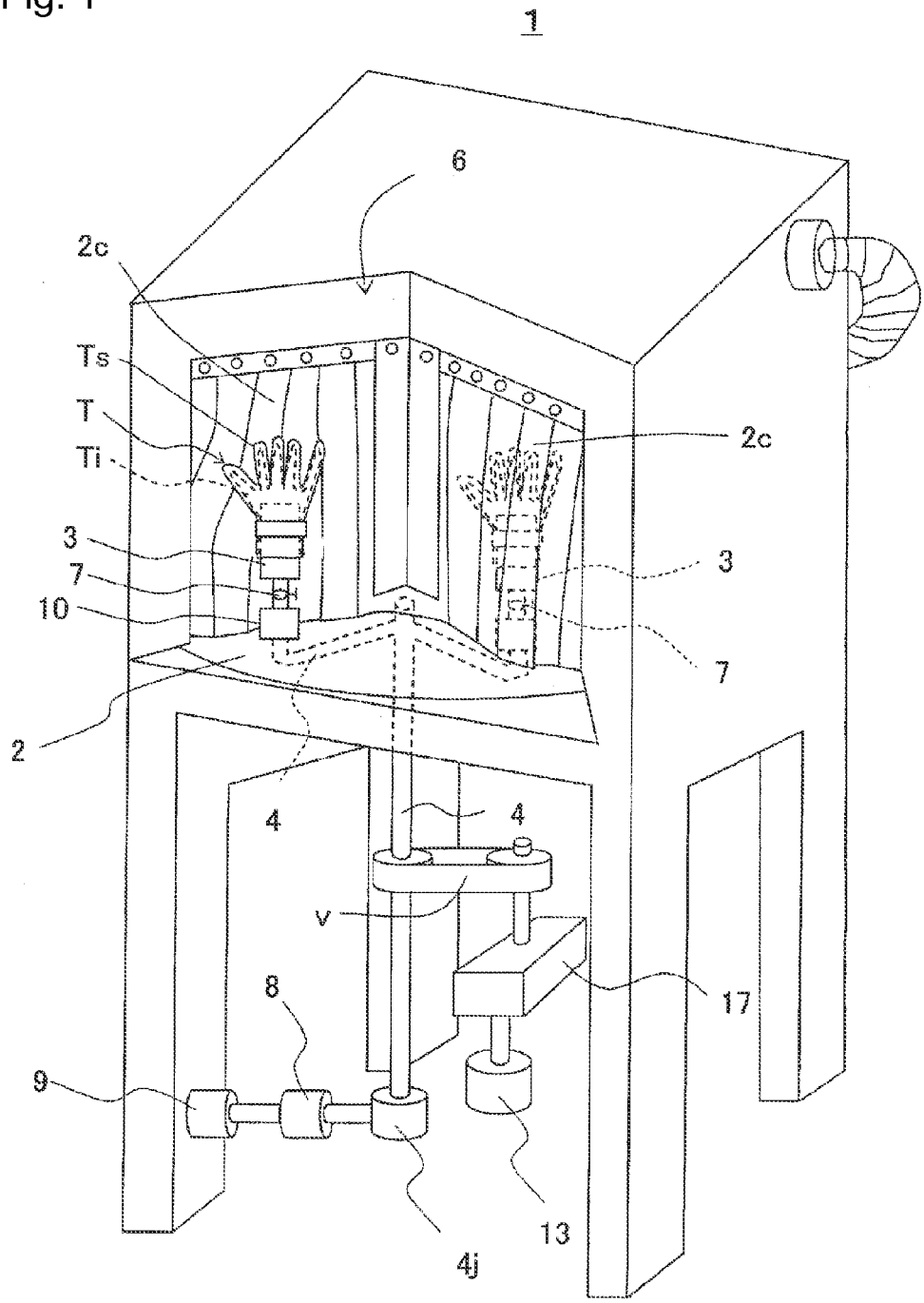

| | | | | |
|---|---|---|---|---|
| 7,971,275 | B2 * | 7/2011 | Saunders et al. | 2/161.6 |
| 2004/0038842 | A1 | 2/2004 | Fagg et al. | |
| 2005/0095273 | A1 * | 5/2005 | Yano et al. | 424/443 |
| 2005/0118916 | A1 | 6/2005 | Ducker et al. | |
| 2008/0121835 | A1 | 5/2008 | Morlacchi | |
| 2008/0156436 | A1 | 7/2008 | Johnson et al. | |

FOREIGN PATENT DOCUMENTS

| | | | | |
|---|---|---|---|---|
| JP | 40-35878 | Y2 | | 12/1965 |
| JP | 51-131584 | A | | 11/1976 |
| JP | 7-155682 | A | | 6/1995 |
| JP | 7-216609 | A | | 8/1995 |
| JP | 8-109504 | A | | 4/1996 |
| JP | 9-296312 | A | | 11/1997 |
| JP | 2000-175938 | A | * | 6/2000 |
| WO | 01/56415 | A2 | | 8/2001 |
| WO | 2008/028913 | A1 | | 3/2008 |

OTHER PUBLICATIONS

Chinese Office Action for CN 201310187552.3 dated May 20, 2014 (including English translation).

* cited by examiner

GLOVE MANUFACTURING METHOD AND MANUFACTURING APPARATUS, AND GLOVE MANUFACTURED BY THE METHOD OR THE APPARATUS

CROSS-REFERENCE TO RELATED APPLICATIONS

This application is a 371 of PCT/JP2009/055948 filed Mar. 25, 2009, which claims the benefit of Japanese Application No. 2008-077740 filed Mar. 25, 2008, and PCT International Application No. PCT/JP2008/063578 filed Jul. 29, 2008, the contents of each of which are incorporated herein by reference.

TECHNICAL FIELD

The present invention relates to a glove manufacturing method and manufacturing device whereby a glove insert is adhered to the inner side of the outer material of a glove.

The present invention claims priority on the basis of Patent Application (Tokugan) 2008-077740 filed in Japan on 25 Mar. 2008 and International Application PCT/JP2008/063578 filed on 29 Jul. 2008, and its content is quoted herein.

BACKGROUND ART

In gloves used in mountaineering and skiing etc, a glove insert formed from a water-resistant film is inserted between the outer material and the inner material of the glove. Regarding the method for adhering the glove insert between the outer material (surface material) and inner material of the glove, a method is known whereby the glove insert is adhered to the outer material and inner material of the glove by means of thermoplastic resin (Patent Document 1). With regards to the insert, as this is itself made in the shape of a glove, in the adhering of this kind of glove insert with the outer material of the glove a mould in the form of fingers and a hand is used, the outer material of the glove and the glove insert are fixed on this mould, heating and compressing is carried out from the exterior and an adhesion operation is carried out by melting thermoplastic adhesive applied to the outside of the glove insert (Patent Document 1).

[Patent Document 1] Unexamined Patent Publication (Kokai) Hei 7-216609

DISCLOSURE OF THE INVENTION

Problems to be Solved by the Invention

However, with the use of this kind of mould in the form of fingers and a hand, it is necessary to provide a mould which suits the glove's style and shape, which leads to high costs. Also with the provision of this kind of mould, in the method of heating and compressing from the exterior it is not possible to provide the requisite heat and pressure to the thermoplastic adhesive between the outer material of the glove and the glove insert, there is a partial lack of adhesion in places, there is the also the appearance of a lack of adhesion, there is insufficient bonding, and there is a problem whereby, when the glove is in use, the glove insert comes away partially from the outer material and inner material. This is a cause of a loss of wearability.

In addition, the adhesion operations using a mould must be manually carried out one at a time which is not only time consuming, but the defect rate is also high and productivity is extremely low.

The purpose of the present invention is to provide a glove manufacturing method and manufacturing device that is able to control variations in bonding between the outer material of the glove and the glove insert, to plan an increase in productivity in terms of operational efficiency and to prevent deformation of the glove.

Means for Solving the Problems

The glove manufacturing method of the present invention is characterised by being a glove manufacturing method whereby a glove insert is adhered to the inner side of the outer material of the glove and, as a glove insert with adhesive applied on the outer side is inserted on the inner side of the outer material of the glove, gas is injected into the glove insert by way of a gas injection means, the glove insert is expanded and the outer material of the glove bonds with the glove insert.

According to the present invention, as gas is injected from the opening of the glove insert with adhesive applied on the outer side of the glove insert, the glove insert expands due to the gas and the glove insert adheres to the outer material of the glove due to the pressure of the gas, the outer material of the glove and the glove insert bond due to the adhesive between the outer material of the glove and the glove insert.

Although thermoplastic adhesive is preferable as the adhesive of the present invention, concerning the heat treatment of the thermoplastic adhesive, the carrying out of heat treatment in a heating furnace to bond the outer material of the glove and the glove insert, and the carrying out of heat treatment by the injection of heated gas into the glove insert to bond the outer material of the glove and the glove insert are both satisfactory. Also, when the heat treated glove is being cooled, it is preferable for the glove insert to be cooled in the state where gas has been injected. When gas is removed immediately after heat treatment, as the thermoplastic resin is warm it is not thoroughly solidified, and the outer material of the glove and the glove insert are not adequately bonded. Furthermore, with regards to cooling, it is preferable that the cooling arranged in the cooling process is natural cooling.

Furthermore, during the heat treatment, further pressure is applied to the glove insert and, when compared to the initial phase of heat treatment, it is preferable for the amount of pressure applied in the glove insert to be increased. When this kind of action is undertaken, and concerning the use of an easily deformable outer material of the glove, when the glove insert is adhered, it is possible to control the occurrence of defective products and increase productivity by being able to control the deformation of the outer material of the glove in the majority of cases by use of a control cover (a cover to control deformation caused by abnormal expansion of the outer material of the glove due to the gas injected in the glove insert). Moreover, as it is possible to exert adequate pressure to the inside of the glove insert in order to bond firmly the glove insert and the outer material of the glove, it is also possible to provide a glove where the variation in bonding of the glove insert and the outer material of the glove has been controlled.

It is preferable for the treatment time at increased pressure due to the application of pressure during the aforementioned heat treatment to be 3 seconds-20 seconds. If the time is less than 3 seconds, the glove insert and the outer material of the glove are not able to be bonded firmly. It is also feared that, if 20 seconds is exceeded, the outer material of the glove Ts will be stretched and unable to return to its original state.

It is preferable for the pressure at the aforementioned initial phase of heat treatment during the aforementioned heat treatment process to be more than 0.0001 MPa and less than 0.003

MPa, and for the increased pressure due to the application of pressure to be more than 0.003 MPa and less than 0.05 MPa.

If the pressure during the aforementioned initial phase of heat treatment does not reach 0.0001 MPa (0.001 kg/cm$^2$), a space can be formed between the outer material of the glove Ts and the glove insert Ti, and, when pressure is applied after this, the outer material of the glove Ts and the glove insert Ti are not bonded adequately and there is the fear that the there will be places where there is a partial lack of bonding and that adequate bonding strength will not be obtained.

Furthermore, if the pressure during the aforementioned initial phase of heat treatment exceeds 0.003 MPa, it is feared that, in relation to the shape of the outer material of the glove Ts, deformation will occur.

If the increased pressure due to the application of pressure does not reach 0.003 MPa, the glove insert and the outer material of the glove will not be able to be bonded firmly.

When the increased pressure due to the application of pressure exceeds 0.05 MPa (0.5 kg/cm$^2$), it is feared that the outer material of the glove Ts will be stretched and unable to return to its original state.

After gas has been inserted in the glove insert by way of the gas injection means, the glove insert has expanded and the outer material of the glove and the glove insert have been bonded firmly, it is best if the glove insert gas is isolated by way of a gas isolation means in order to control the outward flow of the gas to have been injected in the glove insert, a glove holding member to hold the outer material of the glove and the glove insert is separated from the aforementioned gas injection means and the aforementioned glove holding member is moved to the heating furnace.

In this situation, as it is possible to separate the device to inject gas in the glove insert Ti and the device for heat treatment (heating furnace), it is possible to carry out the management of the gas injection device and the heating furnace separately. For example, with regards to one gas injection device, it is possible to arrange a plurality of heating furnaces and preferentially handle the heat treatment process. In addition, with regards to one heating furnace, it is also possible to arrange a plurality of gas injection devices and preferentially handle the gas injection process.

It is also appropriate for the warmed gas to be injected in the glove insert by means of the gas injection means by way of the glove holding member, (preliminary heat treatment), for the glove holding member to be conveyed to the heating furnace, and for the softening or melting of the thermoplastic adhesive to be carried out by applying heat at the heating furnace. In this situation, although it is also possible for the thermoplastic adhesive to be softened or melted in the warmed gas, it is preferable for it to be preheated in the warmed gas, namely for the thermoplastic adhesive to be at a temperature where it does not melt and, after this, for heat to be applied in the heating furnace and for the thermoplastic adhesive to be softened or melted.

The glove manufacturing device of the present invention is characterised by being a glove manufacturing device whereby a glove insert is adhered to the inner side of the outer material of the glove and possessing a glove holding member to hold the glove parts in the state when the glove insert has been inserted in the inner side of the outer material of the glove and a glove injection means to inject gas in the glove insert.

According to the present invention, it is possible, by means of the aforementioned glove holding member, to hold the glove parts in the state when the glove insert has been inserted in the inner side of the outer material of the glove and, when the gas is injected in the glove insert by way of the gas injection means, to expand the glove insert. Consequently, when the glove insert with adhesive applied on the outer side is inserted in the outer material of the glove and gas is injected from the opening of the glove insert, as the glove insert expands and the glove insert bonds with the outer material of the glove with the pressure of the gas, the outer material of the glove and the glove insert bond together due to the adhesive between the two.

Concerning the present invention, the aforementioned glove holding member has a hollow internal passageway, and it is preferable that the aforementioned gas injection means is connected to this glove holding member. According to the present invention, as it is possible for gas to be injected in the glove insert from the gas injection means by way of the glove holding member with a hollow internal passageway, for example, by means of supporting the aforementioned glove holding member from the exterior, complex operations such as injecting gas with the aforementioned gas injection means are not necessary.

Concerning the present invention, there is, on the aforementioned glove holding member, a gas isolation means to control the outward flow of gas and, on the aforementioned glove holding member, it is preferable for a pressure regulation means to be connected in order to prevent the pressure of gas injected in the glove insert from increasing over a certain value. In addition, the glove holding member is fixed on a turntable so that it can be attached and detached at will, by rotating the turntable the glove holding member is conveyed to the heating furnace disposed at a designated position at the turntable and the thermoplastic adhesive is softened or melted, and, after a designated interval of time, the glove holding member is returned to the inlet/outlet and a gain in efficiency of the adhesion operation of the glove insert at the inner side of the outer material of the glove can be planned.

Concerning the present invention, it is preferable that there is a heating furnace. In this situation, after gas has been injected, it is possible for heat treatment to be carried out quickly and a gain in operational efficiency can be planned.

Concerning the present invention, it is preferable for there to be a coupling member to couple the aforementioned glove holding member to the aforementioned gas injection means and for the coupling member to have a valve mechanism. In this situation, when the glove holding member is detached from the coupling member, it is possible to stop the outward flow of the gas from the gas injection means. Consequently, the internal pressure of the gas injection means is stabilised and the productivity of the gas injection process is increased. Furthermore, there is no unnecessary waste of gas.

By means of the aforementioned method, it is possible to manufacture the glove of the present invention. By means of the aforementioned device, it is possible to manufacture the glove of the present invention.

Effects of the Invention

According to the present invention, the glove insert expands due to the injection of gas, the glove insert is bonded to the outer material of the glove, and the adhesive bonds by intervening between the outer material of the glove and the glove insert. Consequently, with just the expansion of the glove insert by means of gas, it is possible for the variation in bonding to be controlled and the glove can be finished in an appropriate form. Furthermore, there is a relatively simple device for injecting gas and, by use of a turntable, by conveying the glove parts to have the glove insert inserted in the outer material of the glove to the heating furnace arranged at a designated position at the turntable and softening or melting the thermoplastic adhesive, it is possible to plan a gain in efficiency with regards to the adhesion operation of the glove insert to the inner side of the outer material of the glove and to plan an increase in productivity.

BRIEF DESCRIPTIONS OF THE DRAWINGS

FIG. 1 A perspective view illustrating the glove manufacturing device of the first mode for carrying out the present invention.

Figure 2:
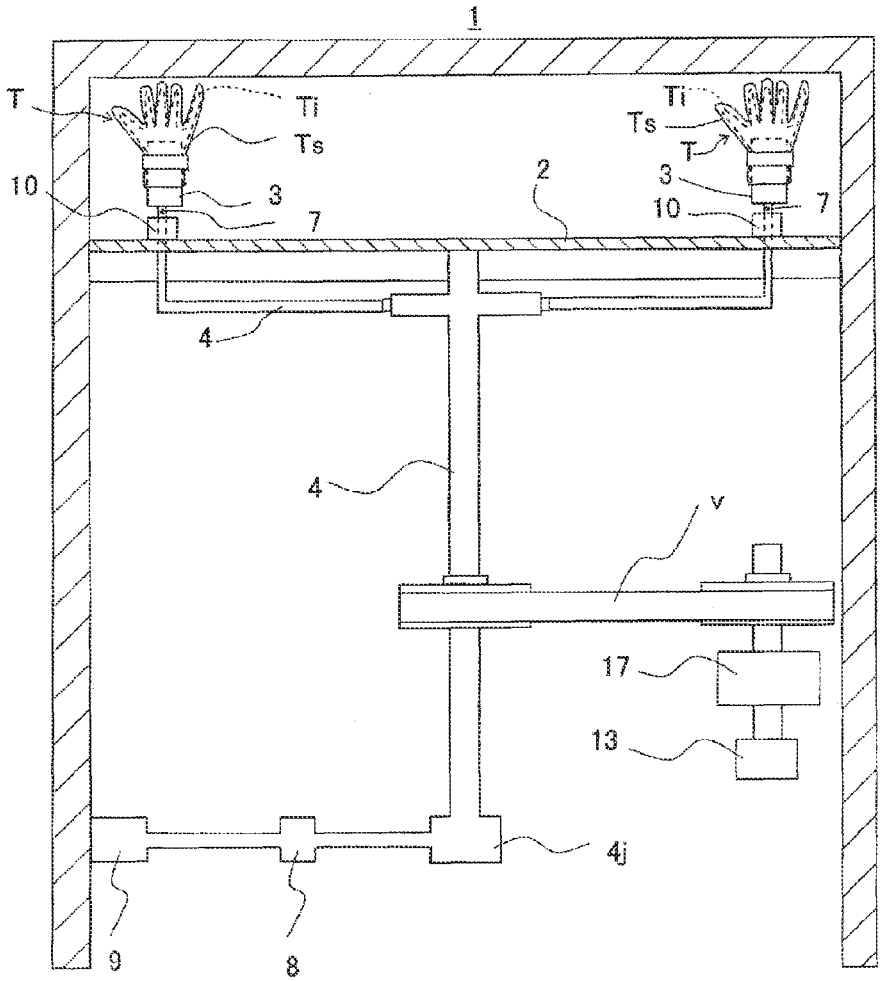

FIG. 2 A sectional view of the aforementioned first mode for carrying out the present invention.

Figure 3:
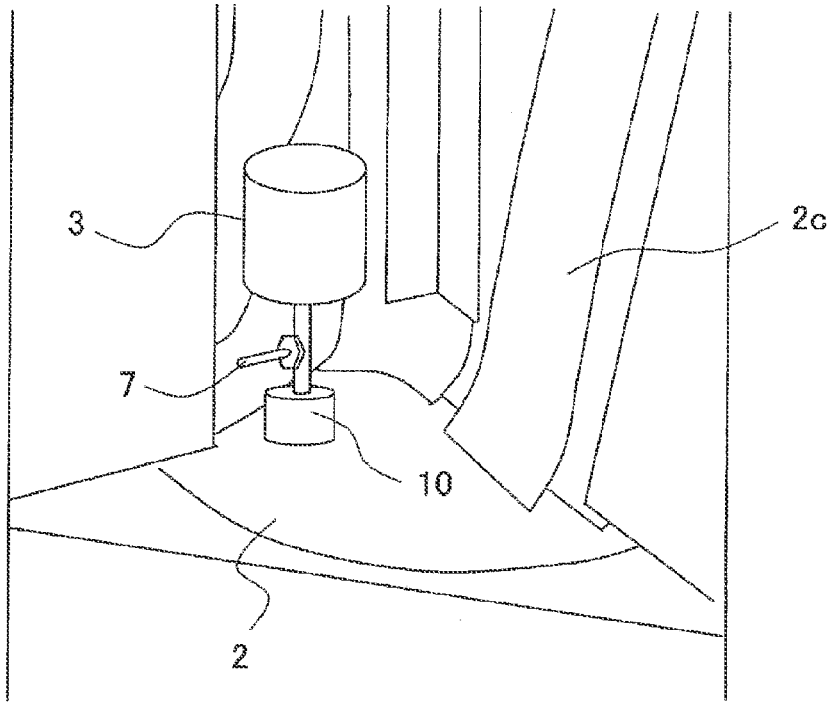

FIG. 3 A perspective view illustrating the glove holding member and coupling part of the aforementioned first mode for carrying out the present invention.

Figure 4:
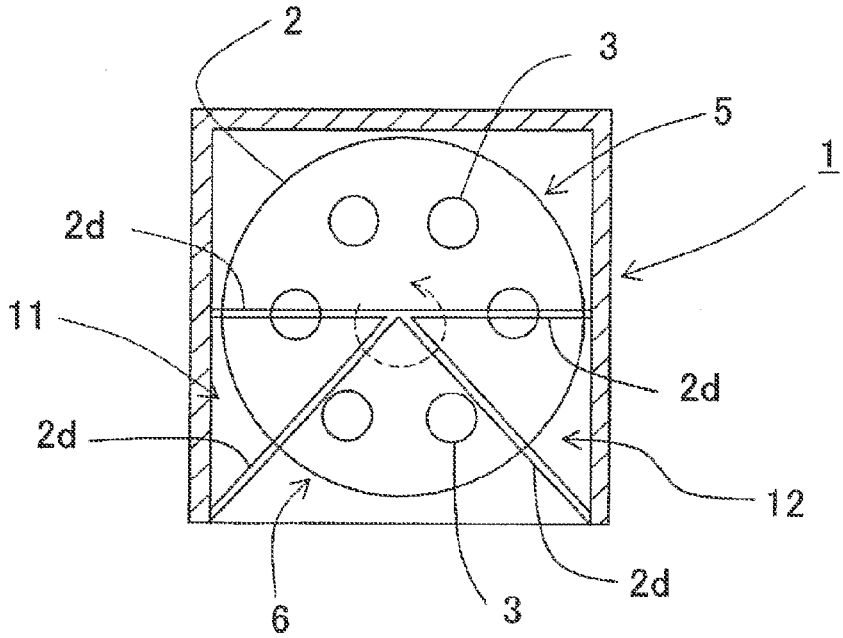

FIG. 4 A plan view illustrating in modular form the arrangement of the preheating chamber, heating furnace and cooling chamber as well as the arrangement of the glove holding member of the aforementioned first mode for carrying out the present invention.

Figure 5:
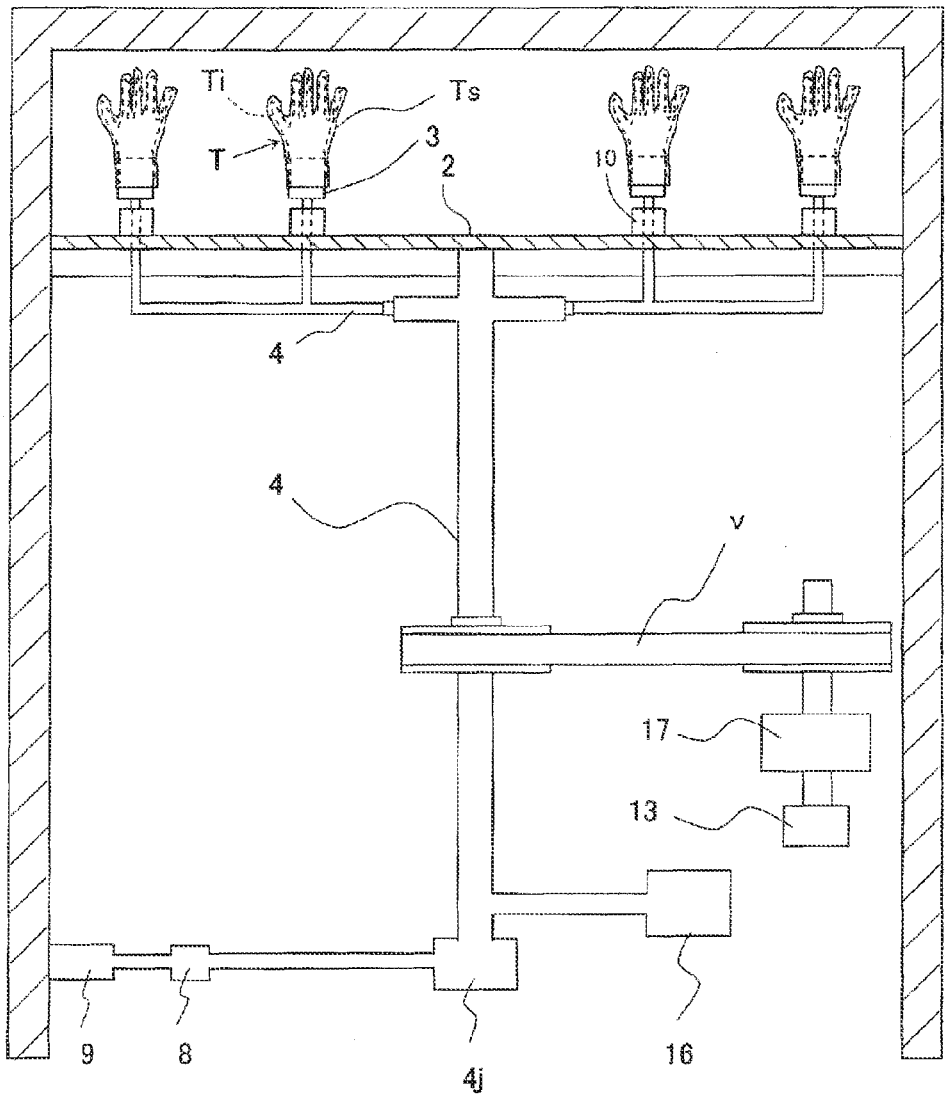

FIG. 5 A sectional view illustrating the glove manufacturing device of the second mode for carrying out the present invention.

Figure 6:
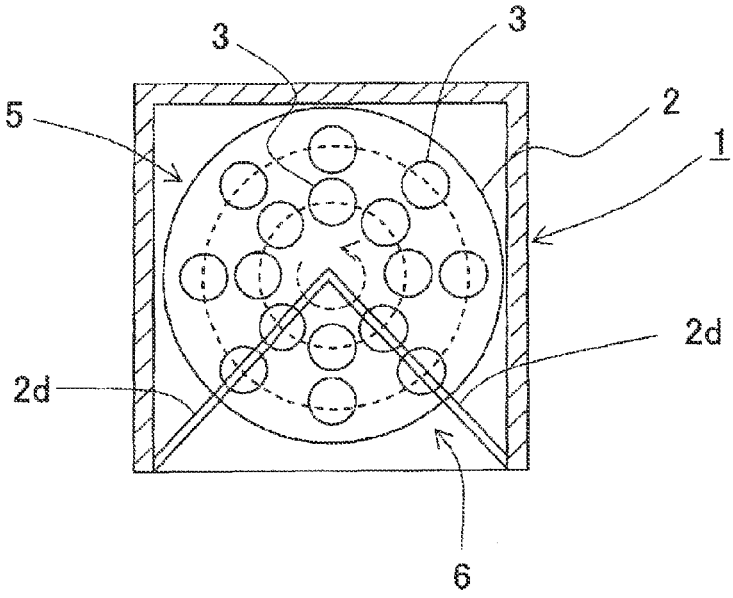

FIG. 6 A plan view illustrating the arrangement of the heating furnace and the arrangement of the glove holding member of the aforementioned second mode for carrying out the present invention.

Figure 7:
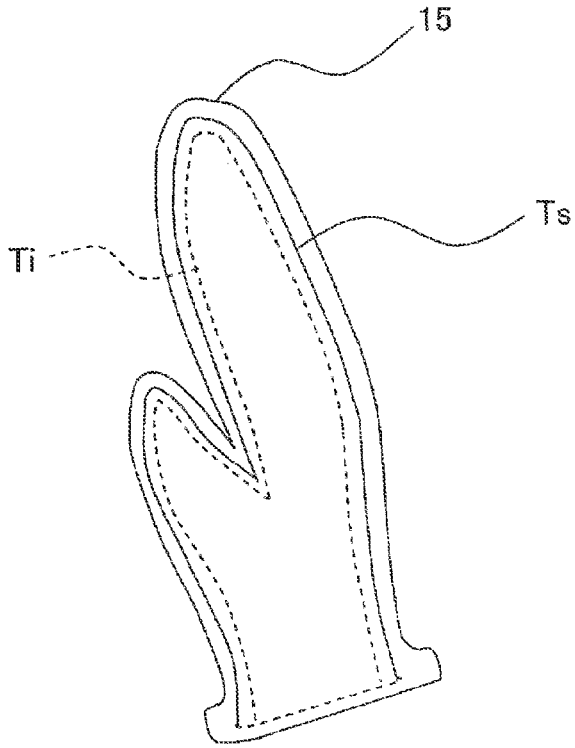

FIG. 7 A sectional view explaining the control cover of the aforementioned modes for carrying out the present invention.

Figure 8:
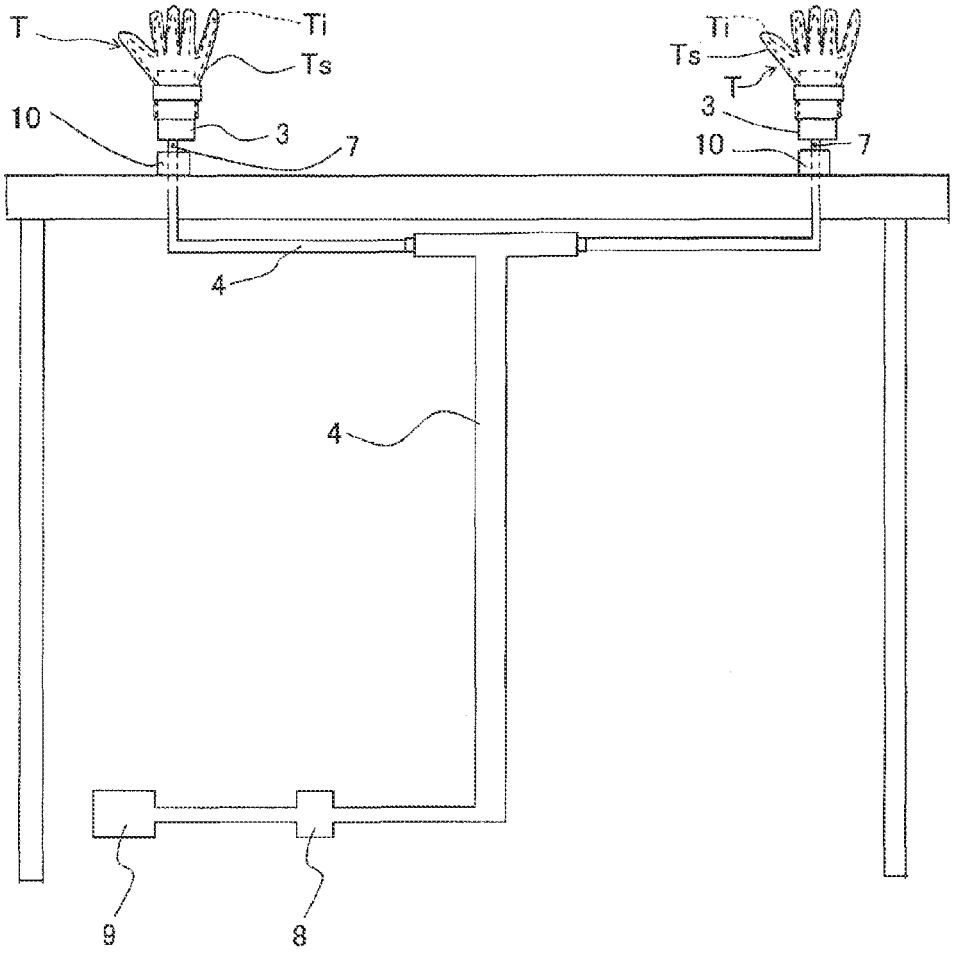

FIG. 8 A side view illustrating the glove manufacturing device of the third mode for carrying out the present invention.

Figure 9:
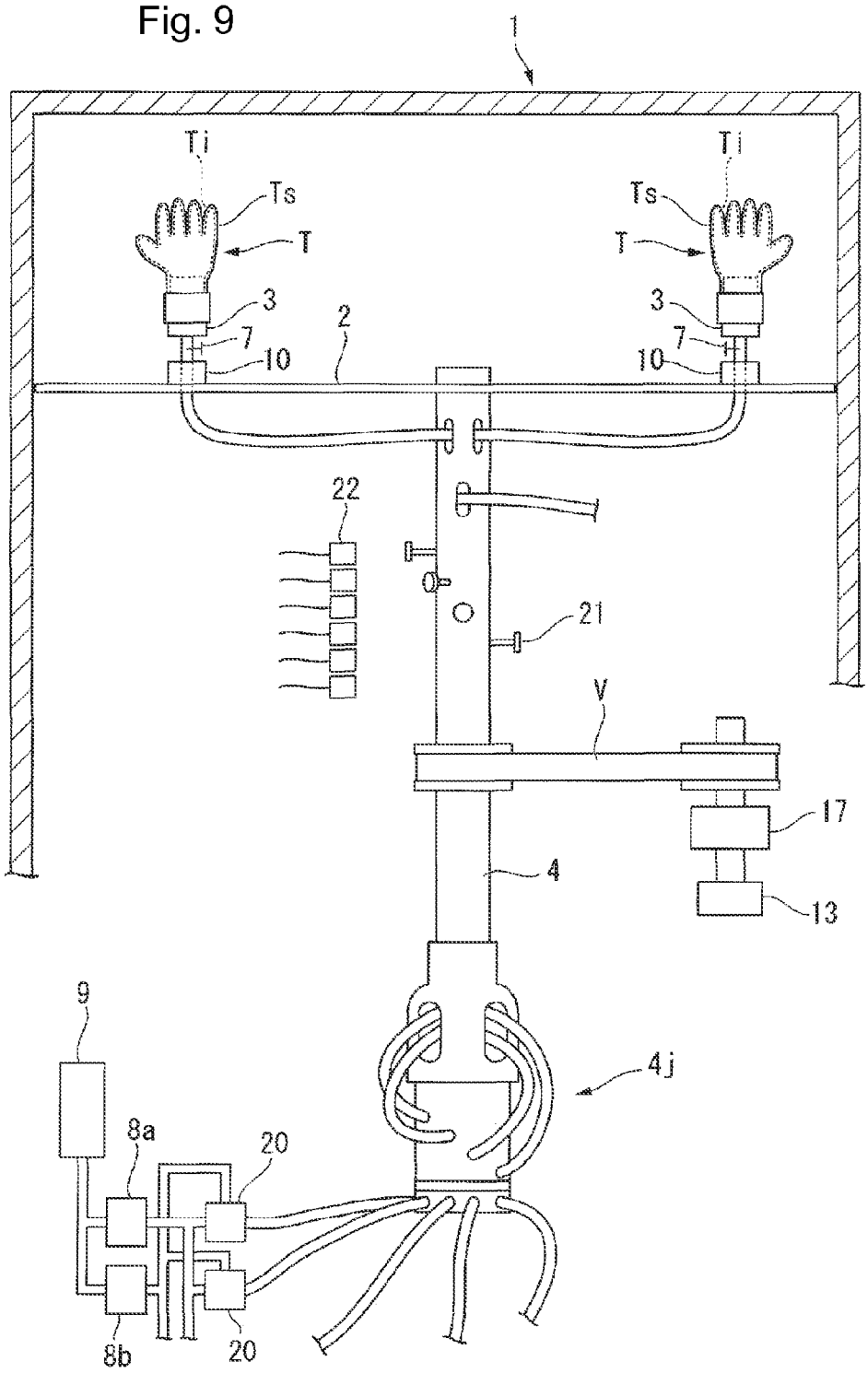

FIG. 9 A side view illustrating the glove manufacturing device of the fourth mode for carrying out the present invention.

Figure 10:
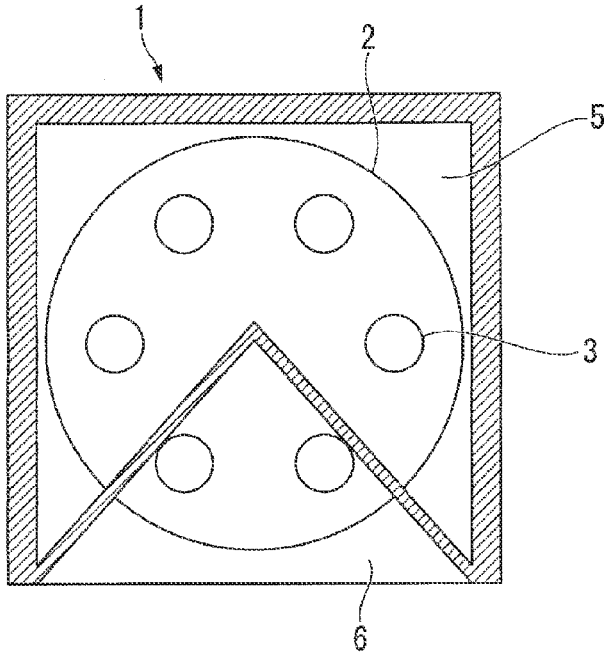

FIG. 10 A plan view illustrating the arrangement of the heating furnace and the arrangement of the glove holding member of the aforementioned fourth mode for carrying out the present invention.

Figure 11:
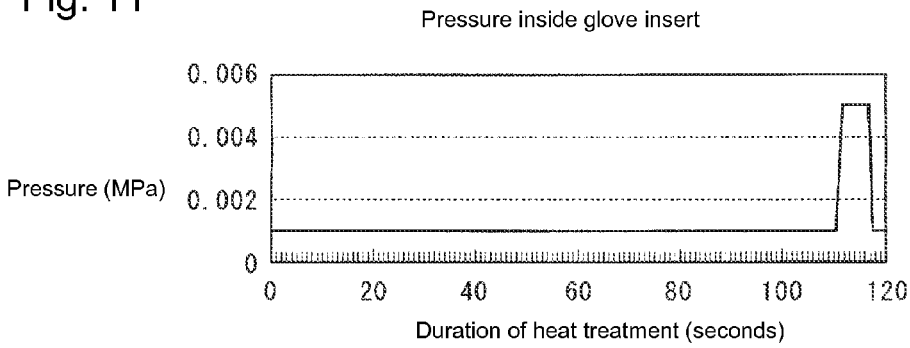

FIG. 11 A graph illustrating the pressure in the glove insert Ti of Embodiment 6.

EXPLANATION OF THE REFERENCE NUMERALS

1 glove manufacturing device
2 turntable
3 glove holding member
5 heating furnace
6 inlet/outlet
7 gas isolation means
8 pressure regulation means
8*a* pressure regulation means for high pressure use
8*b* pressure regulation means for low pressure use
9 gas injection means
10 coupling member
11 cooling chamber
15 control cover
20 electric-pneumatic switch valve
T glove parts (outer material of the glove and glove insert)
Ts outer material of the glove, Ti glove insert

PREFERRED MODES FOR CARRYING OUT THE INVENTION

The following is an explanation with the use of diagrams of the preferred modes for carrying out the present invention.

(First Mode for Carrying out the Invention)

FIG. 1 is a perspective view of the glove manufacturing device and FIG. 2 is a sectional view of the glove manufacturing device of the first mode for carrying out the present invention. FIG. 3 is a perspective view illustrating the fixing status of the glove holding member 3 to the turntable 2. FIG. 4 is a plan view illustrating in modular form the arrangement of the heating furnace 5, cooling chamber 11 and preheating chamber 12 of the turntable 2.

The glove manufacturing device 1 of this mode for carrying out the invention has a turntable 2 and heating furnace 5 arranged on a base and there are glove holding members 3 on the turntable 2. At the glove holding members 3, the gas injecting gas injection means 9 and the pressure regulation means 8 are coupled by means of the shaft 4. Furthermore, the glove holding members 3 have a gas isolation means 7.

The glove applicable to the present invention is a glove such as a ski glove, mountaineering glove, and a glove with a long wrist section such as a glove used in fire-fighting and a glove used for protection against the cold, with the glove having a glove insert (also called a water resistant insert) Ti inserted on the inner side of the outer material of the glove Ts to give water resistance and wind resistance. Furthermore, the final glove product is provided with inner material on the inner side of the glove insert Ti with there being insulation material between the glove insert Ti and the inner material and, moreover, it is also appropriate for a glove insert to be used whereby layers of fabric form the inner material on the inner side of the glove insert Ti.

The glove holding member 3 is an item which holds by covering the openings of the outer material of the glove Ts and the glove insert Ti and, in this mode for carrying out the invention, it holds the glove parts T in a state whereby the glove insert Ti is inserted in the outer material of the glove Ts. The glove holding members 3 can, with a plurality of items arranged around the turntable 2, simultaneously manufacture a plurality of glove parts T (FIG. 4). The glove holding members 3 are fixed on the turntable 2.

As the turntable 2 rotates with the glove holding members 3 in a fixed state, the heating furnace 5 is arranged at the top surface of the turntable 2. Furthermore, the preheating chamber 12 and the cooling chamber 11 are arranged to the front and rear of the heating furnace 5. Namely, there is a structure whereby the inlet/outlet 6 is at the front side of the turntable 2, the heating furnace 5 etc is at the rear side, and, when the turntable 2 rotates one time with the glove holding members 3 to have fixed the aforementioned glove parts T at the inlet/outlet 6 being fixed on the turntable 2 by means of the coupling members 10, the preheating chamber 12, heating furnace 5 and cooling chamber 11 are passed through in sequence and the glove holding members 3 to have fixed the aforementioned glove parts T at the inlet/outlet 6 are returned (FIG. 4). As well as the designated scope of the rotating turntable 2 being divided by walls 2*d*, isolation curtains 2*c* are fixed at the openings formed by these walls 2*d*, forming the heating furnace 5, cooling chamber 11 and preheating chamber 12. The heating furnace applies heat by means of a circulation hot air heater, infrared heater, electric heater, gas etc. The preheating chamber 12, as well having heat applied by means of a circulation type hot air heater, infrared heater, electric heater, gas etc in the same way as the heating furnace 5, can also be heated by the hot air to have leaked from the heating furnace 5 by means of the space of the isolation curtain 2*c* between the heating furnace 5 and the preheating chamber 12. Prior to heat being applied at the heating furnace 5, it is preferable if the glove parts T held at the glove holding members 3 at a temperature between that inside the heating furnace 5 and room temperature could be preheated. Furthermore, the cooling chamber 11, as well as introducing air from outside the cooling chamber by using a blower, ventilation fan etc so that the temperature in the cooling chamber 11 is, due to the use of an air cooling device using cold media etc, lower than that of the heating furnace 5, can also cool the glove parts T held at the glove holding members 3 by the temperature in the cooling chamber 11 being lower than that of the heating furnace 5 due to the inward flow of hot air from the heating furnace 5 to the cooling chamber 11 being controlled due to the isolation curtain 2*c* between the heating furnace 5 and the cooling chamber 11. From the point of view of the stability of the temperature inside the heating furnace 5, there is a preheating chamber 12 and, if not using a compulsory cooling means such as using cooling media, it is preferable that there is the cooling chamber 11 at the isolation curtain 2*c* to control the inward flow of hot air from the heating furnace 5. A shaft 4 to rotate the turntable 2 is arranged under the turntable 2, and the shaft 4 and the turntable 2 are driven to rotate at a designated speed by means of a speed reducer 17 and belt V of a drive motor 13. In this mode for carrying out the invention, as well as there being a heating furnace 5 arranged at the turntable 2, it is possible for there to be a preheating chamber 12 to preheat the glove parts T, and for a cooling chamber 11 to be arranged to cool the glove parts T to have been heated at the heating furnace 5 (FIG. 4), but it is also possible for there just to be a heating furnace 5 (FIG. 6), or for there to be a heating furnace 5 and a cooling chamber 11 arranged, or for there to be a heating furnace 5 and a preheating chamber 12 arranged. Furthermore, as well as the stabilisation of the temperature in the heating furnace 5 by means of the inlet/outlet 6 and the isolation curtain 2*c* when there is no preheating chamber 12 and cooling chamber 11 fixed, it is also possible for there to be a preheating chamber and cooling chamber at the inlet/outlet 6.

The shaft 4 which causes the turntable 2 to rotate is cylindrical or tubular with a hollow passageway formed inside and, beyond this, the gas injection means 9 to feed in gas is connected by means of a rotary joint 4*j* (FIG. 2). The gas injection means 9 can use a compressor, blower, gas cylinder etc and heated gas can also be injected. Gas sent out from the gas injection means 9 passes through the hollow part of the glove holding members 3 and is injected into the glove inserts Ti of the glove parts T. The shaft 4 is coupled to the centre of the turntable 2 and the forks of the shaft 4 from the shaft 4 are coupled to the coupling members 10 adhered to the turntable 2, and the glove holding members 3 are fixed by means of the coupling members 10. The coupling members 10, as well as coupling the shaft 4, can also be coupled so that the glove holding members 3 are inserted and the glove holding members 3 can be attached and detached freely from the turntable 2 by means of the coupling members 10. Furthermore, the coupling members 10 cause the outward flow of gas from the aforementioned shaft 4 due to the insertion of the glove holding members 3 towards the coupling members 10 and, when the glove holding members 3 are detached from the coupling members 10, it is also possible for a valve mechanism to stop the outward flow of gas from the aforementioned shaft 4. The gas isolation means 7 is a cock (valve) etc to control the outward flow of gas, and is fixed below the glove holding members 3. As the cock 7 is fixed, when the glove holding members 3 are detached from the coupling members 10, no gas flows out from the glove holding members 3 due to the closure of this cock 7.

As the glove holding members 3, as well as fixing the glove parts T, also fulfill the role of an injection opening for the injection of gas into the glove inserts Ti, they are, as is the shaft 4, cylindrical or tubular and a hollow passageway is formed inside. Consequently, the glove holding members 3 are fixed on the turntable 2, are coupled with the shaft 4, and gas from the gas injection means 9 is sent to the glove inserts Ti by way of the rotary joint 4*j*. The injection opening (fixing opening) of the glove holding members 3 can be circular or elliptical.

On the shaft 4, the pressure regulation means 8 fitted to maintain the pressure of the glove insert Ti at a determined level is a pressure regulation means 8 with an escape valve. The escape valve is a valve with the function whereby gas at a pressure in excess of the determined pressure can escape. If the pressure of the gas in the glove insert Ti caused by the heat treatment in the heating furnace 5 increases too much, the outer material of the glove Ts or the glove insert Ti stretches too much and, even when the gas pressure is removed, the shape of the outer material of the glove Ts cannot return to its original form and it is feared that this is a cause of glove deformation. As the glove regulation means 8 is a glove regulation means 8 with an escape valve, if the gas pressure of the glove insert Ti is above a determined level, the gas is released from the inside of the glove insert Ti and the pressure in the glove insert Ti is prevented from increasing over a determined level. Also, at the time of injection of gas to the glove insert Ti, it is preferable for there to be a pressure regulation means 8 to prevent an excess of gas being injected and the outer material of the glove Ts being deformed.

The outer material of the glove Ts can be manufactured by using woven cloth, knitting, non-woven material, composite leather, artificial leather, natural leather, plastic film etc and it is also possible for fabric base materials such as woven cloth to be layered on the plastic film and for the glove to be made of a combination of materials such as woven cloth for the back of the hand and natural leather for the palm. The material can also be a chemical fabric such as polyester, nylon, polyamide, acrylic, polyurethane, rayon, acetate and vinyl chloride resin, a natural fabric such as resin, cotton, wool, silk and hemp, and leather such as cow's leather, or a combination of materials. Also, the outer material of this kind of glove Ts, that is a glove with five separate fingers, is, regardless of shape or size, distinguishable from a mitten with a thumb part and one other part for the four fingers. In Patent Document 1 which cites prior art documents, a mould is used for the size and shape of the glove whereas in this mode for carrying out the invention this kind of mould is not used and, to expand the glove insert Ti, a gas is used as a sort of mould to facilitate the expansion, and the shape and size can be flexible.

Although, as long as it can be expanded by means of gas injection, there is no specific limitation on the material of the glove insert Ti, it is preferable for it to be water resistant, and, from the point of view of wearability and performance when the glove is used, it is preferable that it has elasticity. Also, from the point of view of controlling heat and moisture within the glove, it is preferable that it is permeable. Concerning specific materials, non-porous and porous polyurethane film, stretched porous polytetrafluoroethylene film, polyester film, nylon film, vinyl chloride film etc are cited. Furthermore, non-woven material, woven cloth and knitting layered with the aforementioned films are cited. It is also appropriate for two kinds of materials or more to be combined. It is also possible to use a glove insert which is joined by means of a fusion agent or adhesive and where the outer peripheral part of the material used where the glove shape is formed by two glove inserts is removed at the opening where the hand enters and leaves the glove.

Furthermore, with regard to the application of thermoplastic adhesive to the outer side of the glove insert Ti, the glove insert Ti can be manufactured using glove insert material to which adhesive has already been applied or by applying thermoplastic adhesive to this outer side using an air gun, air spray etc after the glove insert has been formed. The adhesive applied to the outside of the glove insert Ti can be applied in dots, lines, checks or over the whole of the outer surface of the glove insert with no spaces.

Moreover, although it is preferable for the glove insert Ti to be approximately the same size as the outer material of the glove Ts or, in the case of a glove insert Ti with elasticity, somewhat smaller than the outer material of the glove Ts, according to the present invention it is also possible to use a glove insert that is larger than the outer material of the glove Ts. Due to this, as it is possible to use the same glove insert Ti regardless of changes in the shape or size of the outer material of the glove Ts, it is not necessary to have a plurality of glove inserts Ti of different sizes and shapes and it is planned that there will be a decrease in cost and a simplification of inventory management.

Next, the glove manufacturing method of this mode for carrying out the invention will be described.

In this mode for carrying out the invention, the manufacturing method is such that the glove insert is adhered to the inner side of the outer material of the glove, the glove insert Ti with adhesive applied to its outer side is inserted into the inner side of the outer material of the glove Ts, gas is injected into the glove insert Ti by way of the gas injection means 9 so that the glove insert Ti is expanded and the outer material of the glove Ts adheres to the glove insert Ti.

Adhesive is applied to the outer surface of the glove insert Ti. Although it is possible for a variety of adhesives such as thermosetting adhesive, thermoplastic adhesive and light curable adhesive to be used, thermoplastic adhesive is preferable as the plasticity caused after the application of heat enables adhesion to be carried out simply at any time. In this mode for carrying out the invention, as heat of the heating furnace 5 and heated gas is injected into the glove insert Ti by the gas injection means 9, thermoplastic adhesive is preferable. Thermoplastic adhesive, also called hot melt adhesive, is a solid adhesive at ambient temperature, and softens and melts when heat is applied. The thermoplastic adhesive is applied to the glove insert Ti, heat is applied to adhere it to the outer material of the glove Ts, the thermoplastic adhesive softens or melts and bonding is carried out by subsequent cooling. The thermoplastic adhesive can be applied to the whole of the outer surface of the glove insert Ti with no spaces, or can be applied in dots, lines or checks. From the point of view of the permeability and handling of the glove parts, dots are preferable, but from the point of view of adhesive power, the application over the whole surface with no spaces is preferable.

A well-known thermoplastic adhesive can be used and, although its softening point can be set arbitrarily according to the material used for the outer material of the glove Ts and the glove insert Ti, from the point of view of bonding, 60° C.-180° C. is preferable.

At the glove holding member 3, the thermoplastic adhesive applied to the glove insert Ti at the inner side of the outer material of the glove Ts is, by contact, fixed to the glove parts T with the glove insert Ti in an inserted state. The fixing of the glove parts T to the glove holding member 3 is carried out with the opening of the glove insert Ti of the glove parts T fitting the form of the outer periphery of the glove holding member 3. The glove parts T may be fixed to the glove holding member 3 by means of use of a band, belt and clamp etc. Using these, the lack of gas leakage when gas has been injected is significant. Furthermore, the combination of elastic objects or rubber etc and bands in the fixing of the glove parts T to the glove holding member 3 is good in terms of gas leakage.

Next, gas is injected into the glove insert Ti by way of the gas injection means 9, causing the glove insert Ti to expand and the outer material of the glove Ts and the glove insert Ti to be bonded. Although it is possible for the gas used to be air, nitrogen, carbon dioxide, helium etc, air is advantageous in terms of cost. Also, with the injected gas, although room temperature is fine, as, when gas which has been heated to 50° C.-90° C. is injected, the thermoplastic adhesive can quickly soften or melt, this is preferable from the point of view of productivity. It is preferable for the pressure of the gas injected into the glove insert Ti to be 0.01-0.5 kg/cm$^2$ (1.0-49 kPa). When lowered to 0.01 kg/cm$^2$ (1.0 kPa), there is the fear that the glove insert Ti will not bond adequately with the outer material of the glove Ts, and, when increased to 0.5 kg/cm$^2$ (49 kPa), there is the fear that the outer material of the glove Ts will stretch and not return to its original state. Furthermore, when necessary, a control cover 15 can be used to prevent the stretching of the outer material of the glove Ts (FIG. 7).

After the glove insert Ti has been inserted in the outer material of the glove Ts, and before gas has been injected into the glove insert Ti, the finger tip parts are preheated using a cylindrical iron etc to 80° C.-200° C., the finger tips of the glove insert Ti and the finger tips of the outer material of the glove Ts are preliminarily bonded, and the finger tips of the glove insert Ti and the outer material of the glove Ts are fixed, which is preferable from the point of view of stability of bonding. In addition, in relation to the fingers and finger crotch parts, after the glove insert Ti has been inserted in the outer material of the glove Ts in the same way, before gas has been injected into the glove insert Ti these parts are preheated using a cylindrical soldering iron etc to 80° C.-200° C., the finger crotch parts of the glove insert Ti and the finger crotch parts of the outer material of the glove Ts are preliminarily bonded, and the finger crotch parts of the glove insert Ti and the outer material of the glove Ts are fixed, which is preferable from the point of view of stability of bonding.

Next, heat treatment is carried out. When the turntable 2 is rotated, the glove parts T are conveyed into the heating furnace 5, heat treatment is carried out, and, with the outer material of the glove Ts and the glove insert Ti in a bonded state, the thermoplastic adhesive on the outside of the glove insert Ti softens or melts. Although the extent of the heat treatment by the heating furnace 5 may be set arbitrarily in accordance with the material of the outer material of the glove Ts and the glove insert Ti, and the softening point of the thermoplastic adhesive, it is better for heat treatment to be carried out at 60-200° C. If the gas pressure inside the glove insert Ti has risen due to the heat treatment, and especially if thin material is used as the outer material of the glove Ts making it easy for deformation to occur, it is preferable from the point of view of maintaining the shape of the glove parts T for gas to escape by way of the pressure regulation means 8 to control the increase in gas pressure in the glove insert Ti when it is above a certain value. Furthermore, when necessary, a control cover 15 can be used to prevent the stretching of the outer material of the glove Ts (FIG. 7).

It is appropriate for the duration of the heat treatment, depending on the material of the outer material of the glove Ts and the glove insert Ti, the softening point of the thermoplastic adhesive applied to the glove insert Ti and the extent of heat treatment, to be 10 seconds-10 minutes. 1 minute-5 minutes is preferable from the point of view of the stability of bonding and the productivity of the obtained glove. If the duration of heat treatment is less than 10 seconds, there is the fear that the outer material of the glove Ts and the glove insert Ti may not be bonded adequately, whereas if the duration of the heat treatment is over 10 minutes, this is not suitable in terms of productivity. Furthermore, it is also acceptable for the glove parts T to be preheated in the preheating chamber 12 prior to heat being applied in the heating furnace 5.

After the heat treatment has been carried out for a designated length of time at the heating furnace 5, cooling is carried out by way of the cooling means of the cooling chamber 11 arranged after the aforementioned heating furnace 5 (FIG. 4). This cooling is cooling in the state whereby gas has been injected into the glove insert Ti by way of the gas injection means 9. Also, after the heat treatment has been carried out for a designated length of time at the heating furnace 5, it is also appropriate for the glove parts T where the glove insert Ti has been inserted into the outer material of the glove Ts to be taken out to the inlet/outlet 6 and for the thermoplastic adhesive to be cooled naturally. In this situation, at the inlet/outlet 6, after the glove parts T to have left the heating furnace 5 have been fixed and the cock (gas isolation means) 7 of the glove holding member 3 has been closed, as the glove holding member 3 is removed from the turntable 2 and the gas to have been injected by way of the gas injection means 9 in the glove insert Ti is cooled in an injected state, the thermoplastic adhesive which has been softened by heating is cooled. When the cooling is completed, as the thermoplastic resin has hardened, it is possible for the gas in the glove insert Ti to be removed, and for the glove parts T to be detached from the glove holding member 3, and, due to this, the bonding of the glove insert Ti and the outer material of the glove Ts is stabilised. Furthermore, it is also possible for a method to be carried out whereby gas is removed from the glove insert Ti and cooling is carried out. However, the aforementioned way whereby cooling is carried out in the glove insert Ti in the state where the gas has been caused to flow in is better. As the thermoplastic adhesive is not adequately hardened directly after leaving the heating furnace 5, if the glove holding member (a glove holding member without a gas isolation means 7 or glove holding member where the gas isolation means 7 is not closed) 3 is removed from the turntable 2 directly after leaving the heating furnace 5, and the glove parts T are removed from the glove holding member 3, gas is removed from the gas insert Ti and there is the fear that the glove insert Ti will partially peel off from the outer material of the glove Ts due to the sudden changes in pressure of the glove parts T. With the prevention of the outward flow of gas by the gas isolation means 7 installed on the glove holding member 3, the bonding of the glove insert Ti and the outer material of the glove Ts is stabilised. In this way, the thermoplastic adhesive is hardened and the glove parts T are manufactured with the glove insert Ti bonded to the inside of the outer material of the glove Ts.

Furthermore, at the time of the injection of gas to the glove insert Ti in the aforementioned way and the increase of pressure in the heating furnace, a method to prevent the deformation of the outer material of the glove Ts when gas pressure in the glove insert Ti is too high is cited whereby a control cover 15 is used so that the outer material of the glove Ts does not stretch too much (FIG. 7). Although it is preferable for this control cover 15 to be almost the same size as the glove, if the outer material of the glove Ts has stretched and the glove insert Ti has returned to its original size, it is also satisfactory for the control cover 15 to be larger than the outer material of the glove Ts. Although it is preferable for this control cover 15 to have 5 fingers, it is also satisfactory, as it is best for the stretching of the outer material of the glove Ts to be prevented, for it not to have the whole of the 5 fingers.

(Second Mode for Carrying out the Invention)

In the second mode for carrying out the invention, as is shown in FIG. 5 and FIG. 6, a structure is adopted whereby, on the shaft 4, a suction means 16 is coupled to remove gas from inside the glove inserts Ti. In particular, if the gas injected into the glove inserts Ti is not air, and nitrogen and helium etc are injected, as air is removed from inside the glove inserts Ti etc, the injection of nitrogen and helium etc is effective. Concerning this kind of glove holding members 3 and shaft 4, although it is possible to use one pipe, it is also appropriate for two and three pipes to be used so that, when gas is injected and gas (air) is removed, separate pipes are used. Also, in this mode for carrying out the invention, a cooling chamber 11 and a preheating chamber 12 are not arranged as in the first mode for carrying out the invention, and, furthermore, the glove holding members 3 of this mode for carrying out the invention are arranged on the inside and outside in the direction of travel of the turntable 2, and it is also possible for there to be more glove holding members 3 than in the first mode for carrying out the invention.

Moreover, in the first and second modes for carrying out the invention, a manufacturing device is also appropriate whereby, with regards to the use of the turntable 2, the turntable 2 is replaced by a loop type conveyor belt on which the glove holding member 3 is fixed and, when the conveyor belt rotates, the glove holding member 3 enters the heating furnace 5, heat treatment is carried out for a designated period of time, and the glove holding member 3 returns to the inlet/outlet. Furthermore, the glove holding member 3 in this situation is not an item as in the first mode for carrying out the invention whereby there are branches from one central shaft 4 with a plurality of glove holding members 3, but, as one glove holding member is connected from one shaft 4, the holding and rotation of glove parts T one at a time is possible.

(Third Mode for Carrying out the Invention)

This mode for carrying out the invention, as is shown in FIG. 8, is a device whereby there are coupling members 10 on the base, a gas injection means 9 is coupled to the coupling members 10, the glove holding members 3 are fixed to the coupling members 10 and gas such as air is injected into the glove inserts from the gas injection means 9, and a glove manufacturing device whereby a heating furnace is used in which specially provided heat treatment is possible. Namely, the device for injecting gas into the glove inserts Ti and the device for heat treatment (heating furnace) are separate, and, after gas has been injected into the glove inserts Ti, gas is confined within the glove inserts Ti by means of the gas isolation means 7. Next, the glove holding members 3 are detached from the coupling members 10, the glove holding members 3 are moved to the heating furnace and heat treatment is carried out on the glove parts T so that the glove insert Ti and the outer material of the glove Ts are bonded by means of thermoplastic adhesive. Furthermore, in this mode for carrying out the invention, although there is no means such as a turntable for conveying the holding members 3, a pressure regulation means 8 is installed. In addition, it is also appropriate for a suction means 16 etc to be installed.

The glove manufacturing method is such that, after the glove parts T have been made by the glove insert Ti with thermoplastic adhesive applied to the outer side being inserted into the inner side of the outer material of the glove Ts, the glove parts T are fixed to the glove holding member 3. Next, the glove holding member 3 is fixed to the coupling member 10, gas is injected in the glove insert Ti, the glove insert Ti is expanded, and the outer material of the glove Ts and the glove insert Ti are bonded. At this time, in the same way as in the first and second modes for carrying out the invention, the thermoplastic adhesive applied to the outer side of the glove insert Ti is present between the glove insert Ti and the outer material of the glove Ts, and bonds with the outer material of the glove Ts. Next, the gas isolation means 7 of the glove holding member 3 is closed, and the gas is confined in the glove insert Ti. The pressure of the injected gas is the same as that of the first and second modes for carrying out the invention. Moreover, the preliminary bonding etc of the glove insert Ti, the outer material of the glove Ts, thermoplastic adhesive and finger tips and finger crotch parts of the glove insert Ti and outer surface of the glove Ts is the same as that of the first and second modes for carrying out the invention.

Next, the glove supporting member 3 with the glove parts T attached which have been removed from the coupling member 10 enter the heating furnace and heat treatment is carried out. Due to the heat treatment, the bonding agent (thermoplastic adhesive) is softened or melted, and the outer material of the glove Ts is bonded to the glove insert Ti. Next, cooling is carried out and the bonding of the outer material of the glove Ts and the glove insert Ti is completed. The temperature at the time of heat treatment and the duration is the same as in the first and second modes for carrying out the invention.

When the heating furnace is used as an item associated with a conveying means such as a turntable 2 or conveyor belt, it is preferable if a glove holding member 3 to have fixed the glove parts T on the conveying means is fixed and heat treatment carried out. Moreover, if a heating furnace is used without a conveying means such as a turntable, the glove holding member 3 to have fixed the glove parts T enters the heating furnace, heat treatment is carried out and, after the necessary period of time, it is appropriate for the glove holding member 3 on which the glove parts T are fixed to be removed from the heating furnace. Concerning the cooling after heat treatment has been carried out, although it is also possible for the gas of the glove insert Ti to be removed, it is preferable, from the point of view of stability of bonding, for cooling to take place in the state where gas has been injected in the glove insert Ti as in the first and second modes for carrying out the invention.

(Fourth Mode for Carrying out the Invention)

In order to adhere the glove insert Ti to the outer material of the glove Ts, gas is injected into the glove insert Ti, heat treatment is carried out, and, concerning the kind of outer material of the glove Ts, the outer material of the glove Ts is deformed (expanded) due to the pressure of injected gas, and, after gas in the gas insert has been removed, there is no return to its original form. This mode for carrying out the invention relates to a glove manufacturing method and device whereby the deformation of the outer material of the glove Ts is controlled when the glove insert Ti is adhered to the outer material of the glove Ts.

In the glove manufacturing method of this mode for carrying out the invention, there is, as in the aforementioned first mode for carrying out the invention, a glove manufacturing method whereby the glove insert Ti is adhered to the inner side of the outer material of the glove Ts, and, when the glove insert Ti with thermoplastic adhesive applied to its outer side has been inserted in the inner side of the outer material of the glove Ts, gas is injected in the glove insert Ti by way of the gas injection means 9, the glove insert Ti is caused to expand and the outer material of the glove Ts is bonded with the glove insert Ti, but, during heat treatment, further pressure is applied in the glove insert Ti and, compared to the initial phase of heat treatment, the pressure in the glove insert is increased.

In this way, and also when an easily deformable outer material of the glove Ts is used, when the glove insert Ti is adhered, in order to control the deformation of the outer material of the glove without using a control cover, as well as controlling the production of defective products, it is also possible to control productivity. In addition, as it is possible to exert adequate pressure towards the inside of the glove insert Ti and to bond firmly the glove insert Ti and the outer material of the glove Ts, it is also possible to provide a glove whereby variation in bonding of the glove insert Ti and the outer material of the glove Ts is controlled.

The outer material of the glove Ts, glove insert Ti and thermoplastic adhesive etc used in this mode for carrying out the invention can be used in the same way as is described in the first mode for carrying out this invention.

Furthermore, concerning the insertion of the glove insert Ti in the outer material of the glove Ts, it is best if this is carried out in the same way as in the first mode for carrying out the invention and, moreover, it is also appropriate for the preliminary bonding of the finger crotch parts of the glove insert Ti and the finger crotch parts of the outer material of the glove Ts, as well as the preliminary bonding of the finger tips of the glove insert Ti and the finger tips of the outer material of the glove Ts to be carried out in the same way as in the first mode for carrying out the invention.

Concerning the conditions of the heat treatment, during the initial phase of the heat treatment, the pressure in the glove insert Ti is lower with the pressure being such that there is no great stretching of the outer material of the glove Ts. The low pressure during the heat treatment varies according to the kind of outer material of the glove Ts, but more than 0.0001 MPa (0.001 kg/cm$^2$) is suitable. It is preferable for it to be more than 0.0005 MPa (0.005 kg/cm$^2$). In addition, lower than 0.003 MPa (0.03 kg/cm$^2$) is appropriate. If 0.0001 MPa (0.001 kg/cm$^2$) is not reached, a space can be formed between the outer material of the glove Ts and the glove insert Ti, and, when pressure is applied after this, the outer material of the glove Ts and the glove insert Ti are not bonded adequately and there is the fear that the there will be places where there is a partial lack of bonding and that adequate bonding strength will not be obtained.

Furthermore, if the pressure exceeds 0.003 MPa, it is feared that, in relation to the shape of the outer material of the glove Ts, deformation will occur.

At the time of heat treatment, the pressure when further pressure has been applied inside the glove insert Ti depends on the kind of outer material of the glove, but less than 0.05 MPa (0.5 kg/cm$^2$) is suitable. More preferable is more than 0.003 MPa (0.03 kg/cm$^2$), but less than 0.01 MPa (0.1 kg/cm$^2$).

If 0.05 MPa (0.5 kg/cm$^2$) is exceeded, it is feared that the outer material of the glove Ts will be stretched and unable to return to its original state.

Although it is suitable for the level of heating and duration of heating during heat treatment to be carried out in the same way as in the first mode for carrying out the invention, in this mode for carrying out the invention further pressure is applied during heat treatment. The timing is such that pressure is applied as per the aforementioned pressure from immediately before the end of heat treatment until less than 20 seconds, with it being appropriate for treatment to be carried out at high pressure for 3 seconds-20 seconds. Consequently, next it is appropriate to return to the pressure of the glove insert Ti to the low pressure of the initial phase of the heat treatment and for cooling to occur.

Concerning cooling, it is appropriate for this to be carried out in the same way as in the first mode for carrying out the invention.

Next follows a description of the device used in this mode for carrying out the invention. Moreover, FIG. 9 and FIG. 10 which show this mode for carrying out the invention describe how heat treatment can be carried out with 6 glove parts T connected, but there is no limitation with regard to this number.

In the glove manufacturing device of this mode for carrying out the invention, there are, as in the first mode for carrying out the invention, a turntable 2, heating means 5, glove holding members 3, gas isolation means 7 and coupling means 10 etc.

In this mode for carrying out the invention, as is shown in FIG. 9 and FIG. 10, in order for it to be possible for there to be changes in gas pressure in each of the plurality of glove inserts Ti during the heat treatment of the glove parts T, detection bolts 21 which are the detection means on the shaft 4, adjacent switches 22 which are the switches to give the switching order to the pressure switch means which detects the detection bolts 21, electro-pneumatic switch valves 20 which are the pressure switch means to switch the pressure of the gas provided to each glove insert Ti, a pressure regulation means for high pressure use 8*a* to provide high pressure gas to the electro-pneumatic switch valves 20, a pressure regulation means for low pressure use 8*b* to provide low pressure gas in the same way to the electro-pneumatic switch valves 20, and, on the pressure regulation means for high pressure use 8*a* and the pressure regulation means for low pressure use 8*b*, a gas injection means 9 to inject gas in the glove inserts Ti are connected.

Furthermore, the electro-pneumatic switch valves 20 are connected to a rotary joint 4*j* and, in addition, are, from the rotary joint 4*j*, connected to a turntable 2, coupling members 10 on the turntable 2, glove holding members 3, and glove parts T by way of hoses, and gas is sent into the glove inserts Ti.

Also, in this mode for carrying out the invention, in order for it to be possible for there to be 6 glove holding members fixed, there are 6 electro-pneumatic switch valves 20. Furthermore, there are, in the same way, also 6 each of detection bolts 21, adjacent switches 22, and connection members 10 etc. In addition, there are also 6 each of connection mouths on the rotary joint 4*j* for letting gas in and removing gas, which each connect the electro-pneumatic switch valves 20 and the coupling members 10 on the turntable 2.

Furthermore, by using the device shown in FIG. 9, when the glove holding members 3 are fixed to the coupling members 10, low pressure gas is injected into the glove inserts Ti and, after this, with predetermined timing, pressure is applied during heat treatment and it is possible for pressure inside the glove inserts to be increased; however, particularly when the glove holding members 3 are, as shown in FIG. 8 and recorded in the third mode for carrying out the invention, fixed on the coupling members 10, a device is used whereby gas such as air from the gas injection means 9 is injected into the glove inserts, a plurality of glove holding members 3 are provided with gas parts T attached which have had low pressure gas injected into the glove inserts Ti (after the gas injection, the gas isolation means 7 is closed in order to provide the outward flow of gas of the glove inserts Ti), the provided glove holding members 3 are, as is shown in the device shown in FIG. 9 as stated in this mode for carrying out the invention, fixed to the coupling members 10, the gas isolation means is opened, heat treatment is carried out, further pressure is applied to the glove inserts Ti during heat treatment, pressure in the glove inserts is increased in comparison to the pressure during the initial phase of heat treatment and the glove inserts Ti and the outer material of the gloves Ts are able to be adhered.

EMBODIMENTS

Embodiment 1

The outer material of the gloves Ts was outer material of the glove for use in skiing manufactured from polyester cloth. The glove inserts Ti were such that thermoplastic adhesive (softening point 85° C.) was applied in spots to one side of non-porous film made from permeable and water-resistant polyurethane resin and punched into a hand shape, 2 of these hand-shaped items with thermoplastic adhesive were layered onto the outer surface of the glove inserts, and the outer peripheral parts, with the exception of the opening where the hand opens and leaves the glove, were bonded and used. The glove inserts Ti were inserted so that the thermoplastic adhesive of the glove inserts Ti joined to the inner side of the outer material of the gloves Ts to form the glove parts T. Glove inserts Ti larger than the outer material of the gloves Ts were used. The glove manufacturing device used was the device of the first mode for carrying out the invention. Due to the insertion of the glove holding members 3 into the coupling members 10, together with the outward flow of gas from the aforementioned shaft 4, when the glove holding members 3 were removed from the coupling members 10, the coupling members 10 with a valve mechanism were used to prevent the outward flow of gas from the aforementioned shaft 4.

Next, a cylindrical iron heated to 100° C. was used to soften the thermoplastic adhesive of the finger tips and finger crotch parts, and the finger tips and the finger crotch parts of the glove inserts Ti were preliminarily bonded with the finger tips and the finger crotch parts of the outer material of the gloves Ts.

Next, after the glove parts T had been fixed on the glove holding members 3 removed from the turntable 2 (fixed with a belt), the glove members 3 were fixed to the turntable 2 by way of the coupling members 10, gas was injected into the glove inserts Ti from the gas means 9 connected to the glove holding members 3 and the glove inserts Ti were caused to expand. At this time, the pressure of the air inside the glove inserts Ti was 0.2 kg/cm$^2$ (19.6 kPa). The turntable 2 was rotated, the glove parts T were conveyed to the heating furnace 5 and heat treatment was carried out at 120° C. for 2 minutes. After 3 minutes (30 seconds of preheating, 2 minutes of heating and 30 seconds of cooling), the glove parts T to have come to the inlet/outlet 6 were, after the cock (gas isolation means 7) was closed, removed along with the glove holding members 3 and the glove parts T were obtained whereby the glove inserts Ti were bonded to the outer material of the gloves Ts by the thermoplastic adhesive.

Furthermore, regarding the recently removed glove holding members 3, the glove holding members 3 with specially provided glove parts T fixed were immediately fixed, gas was injected and the well-planned manufacture of the glove parts T was possible. The glove parts T manufactured in this way had the whole of the outer material of the gloves Ts and the glove inserts Ti bonded firmly and productivity increased. In addition, in the present embodiment, as cooling treatment was carried out in the cooling chamber (50-60° C.), if the glove parts T to have come to the inlet/outlet 6 were removed along with the glove holding members 3 without the cock (gas isolation means) 7 being closed, the thermoplastic adhesive cooled and hardened and the whole of the glove inserts Ti were bonded fully and firmly to the outer material of the gloves Ts with no variation in bonding.

Embodiment 2

After gas (warmed air) with a temperature of 60-80° C. was injected into the glove inserts Ti by way of the glove holding members 3, this was conveyed to the heating furnace 5 by the turntable 2 and heating at 120° C. was carried out in the heating furnace 5. The duration of this heating was 2 minutes. Also, the duration of the cooling treatment was 24 seconds. The isolation curtain 2*c* between the heating furnace 5 and the preheating chamber 12 was removed, and preheating was not carried out in the preheating chamber 12 as well as the heating furnace 5. Apart from this, the method was the same as in Embodiment 1.

The glove parts T manufactured in this way were such that the outer material of the gloves Ts and the glove inserts Ti were bonded fully and firmly and there was no variation in bonding. Also, in comparison with Embodiment 1, when warmed air was injected in place of the preheating chamber, the processing speed was able to be faster. This is because the thermoplastic adhesive on the outer side was able to be softened or melted quickly by the injection of warmed air.

Embodiment 3

The glove manufacturing device of the second mode for carrying out the invention was used without the preheating chamber 12 and cooling chamber 11, and just with the heating furnace 5 being arranged, and, after heat treatment (the duration of the heat treatment being 2 minutes 30 seconds), the glove parts T to have come to the inlet/outlet 6 were, with the cock (gas isolation means) closed, removed along with the glove holding members 3 and natural cooling was carried out for 10 minutes at room temperature. Apart from this, the method was the same as in Embodiment 1, and the glove parts T were obtained. The glove parts T manufactured in this way were such that the outer material of the gloves Ts and the glove inserts Ti were bonded fully and firmly and there was no variation in bonding. Furthermore, productivity was better than with the use of existing moulds.

Embodiment 4

The glove manufacturing device of the second mode for carrying out the invention was used without the preheating chamber 12 and cooling chamber 11, and just with the heating furnace 5 being arranged, and, after air was removed from inside the glove inserts Ti by way of a suction means 16, nitrogen was injected. Then, after heat treatment (the duration of the heat treatment being 2 minutes 30 seconds), the glove parts T to have come to the inlet/outlet 6 were, with the cock (gas isolation means) closed, removed along with the glove holding members 3 and natural cooling was carried out for 10 minutes at room temperature. Apart from this, the method was the same as in Embodiment 1, and the glove parts T were obtained. The glove parts T manufactured in this way were such that the outer material of the gloves Ts and the glove inserts Ti were bonded fully and firmly and there was no variation in bonding. Furthermore, productivity was better than with the use of existing moulds.

Embodiment 5

The glove parts T with the glove inserts Ti with thermoplastic adhesive applied to the outer side inserted so as to join with the inner side of the outer material of the gloves Ts were wound on the glove holding members 3 with a silicon belt and a band was fixed tightly on this. The glove holding members 3 were fixed on the coupling members 10 of the third mode for carrying out the invention with no heating furnace arranged, were connected to the gas injection means 9, air was injected into the glove inserts Ti causing them to expand and the glove inserts Ti and the outer material of the gloves Ts were bonded.

Furthermore, when the glove holding members 3 were removed from the coupling members 10 as in Embodiment 1, the coupling members 10 had a valve mechanism to prevent the outward flow of gas from the gas injection means.

Next, the gas isolation means 7 of the glove holding members 3 were closed, and air was confined in the glove inserts Ti. The glove holding members were detached from the coupling members 10, the glove holding members 3 were moved to the separated heating furnace and heat treatment was carried out for 2 minutes.

Next, the glove members 3 were removed from the heating furnace and natural cooling was carried out for 10 minutes at room temperature. After cooling, the glove parts T were removed from the glove holding members 3, and, when a state of bonding was confirmed, the outer material of the gloves Ts and the glove inserts Ti were fully and firmly bonded with no variation in bonding. However, due to the separation of the gas injection means 9 and the heating means, productivity was worse than that of the aforementioned embodiments.

Furthermore, the outer material of the gloves Ts, the glove inserts Ti, the thermoplastic adhesive, the heat treatment temperature, the air pressure inside the glove inserts Ti and the preliminary bonding of the finger tips and finger crotch parts of the glove inserts Ti and the outer material of the gloves Ts were the same as in Embodiment 1.

Above, in each mode for carrying out the present invention, although the manufacturing of the glove parts T by the adhering of the glove inserts Ti to the inner side of the outer material of the gloves Ts, a glove could be obtained by fixing the inner material to these glove parts T by well-known methods.

Embodiment 6

In the present embodiment, the glove manufacturing method of the fourth means for carrying out the invention was used.

The outer material of the gloves Ts was outer material of a glove for use in golf manufactured from layers of vinyl chloride resin film on one side of cloth. The glove inserts Ti were such that a non-porous film made from permeable and water-resistant polyurethane resin was punched into a hand shape, 2 of these hand-shaped items were layered onto this hand shape, the outer peripheral parts, with the exception of the opening where the hand enters and leaves the glove, were bonded, and the glove inserts were obtained. Next, powdered thermoplastic adhesive (softening point 75° C.) was sprinkled onto the whole of the outer surface of the glove inserts and the glove inserts with thermoplastic adhesive applied to the outer side were used.

The glove inserts Ti were inserted so that the thermoplastic adhesive of the glove inserts Ti joined to the inner side of the outer material of the gloves Ts to form the glove parts T. Glove inserts Ti larger than the outer material of the gloves Ts were used.

Next, a cylindrical iron heated to 100° C. was used to soften the thermoplastic adhesive of the finger tips and finger crotch parts, and the finger tips and the finger crotch parts of the glove inserts Ti were preliminarily bonded with the finger tips and the finger crotch parts of the outer material of the gloves Ts.

Next, the glove parts T were fixed on the glove holding member 3. A rubber belt was wrapped around the wrist part lying on the glove parts T and the glove holding members 3 and a clamp above this was used to fasten.

The air isolation means 7 of the glove members 3 upon which the glove parts T were fixed were closed, the glove holding members 3 were fixed onto the coupling members 10 of the device of FIG. 8 used in the third mode for carrying out the invention, and air was injected into the glove inserts Ti. The pressure of the glove inserts Ti at this time was 0.001 MPa (0.01 kg/cm$^2$). To repeat this operation, a plurality of glove holding members 3 were provided upon which glove parts T were fixed with air having been injected into the glove inserts Ti. Furthermore, when the glove holding members 3 were detached from the coupling members 10 as in Embodiment 1, the coupling members 10 of FIG. 8 had valve mechanisms to prevent the outward flow of gas from the gas injection means.

Next, the air isolation means of the glove holding members 3 were closed, the glove holding members 3 were removed from the device of FIG. 8 of the third mode for carrying out the invention and fixed to the coupling members 10 on the turntable 2 of the glove manufacturing device of the fourth mode for carrying out the invention shown in FIG. 9, and the air isolation means 7 of the glove holding members 3 were opened. The glove holding members 3 were connected to the pressure regulation means for low pressure use 8*b* by way of the heat resistant hose passing through the hollow shaft 4, 6 rotary joints 4*j* and electro-pneumatic switch valves 20, and the pressure regulation means for low pressure use 8*b* was connected with the gas injection means 9. The pressure regulation means for low pressure use regulated the pressure to 0.001 MPa (0.01 kg/cm$^2$). Furthermore, the coupling members 10 had valve mechanisms to prevent the outward flow of gas from the gas injection means.

The turntable 2 was rotated at a designated speed, the glove parts T were conveyed to the heating furnace 5 (heated by a circulation hot air heater) and heat treatment was carried out at 120° C. (120 seconds). 8 seconds prior to the end of heat treatment, there was a switch from the pressure regulation means for low pressure use 8*b* to the pressure regulation means for high pressure use 8*a* by means of the electro-pneumatic switch valves 20, pressure of 0.005 MPa (0.05 kg/cm$^2$) was applied inside the glove inserts and the heat treatment continued for 6 seconds. 2 seconds prior to the end of heat treatment (with the glove holding members coming to the inlet/outlet), there was a switch from the pressure regulation means for high pressure use 8*a* to the pressure regulation means for low pressure use 8*b*, and there was a return to the original pressure of 0.001 MPa (0.01 kg/cm$^2$) inside the glove inserts. A graph showing the pressure inside the glove inserts during heat treatment is shown in FIG. 11.

Concerning the switch from the pressure regulation means for low pressure use 8*b* to the pressure regulation means for high pressure use 8*a*, the detection bolts 21 fixed on the shaft 4 were detected at the adjacent switches 22 and a switching order was given to the electro-pneumatic switch valves. Moreover, concerning the switch from the pressure regulation means for high pressure use 8*a* to the pressure regulation means for low pressure use 8*b*, 6 seconds after the switch from the pressure regulation means for high pressure use 8*a*, the order was given to the electro-pneumatic switch valves for the switch to the pressure regulation means for low pressure use 8*b*.

When the heat treatment had finished, the glove holding members 3 to have come to the inlet/outlet 6, with the gas isolation means 7 closed, were, along with the glove parts T, detached from the coupling members 10 on the turntable 2 and, in the state whereby gas was injected in the glove inserts Ti, cooling was carried out for 20 seconds at room temperature. After this, the glove parts T were removed from the glove holding members 3. The glove holding members 3 upon which the glove parts T were attached with gas injected in the glove inserts Ti which were provided in advance by using the device of FIG. 8 were immediately fixed on these coupling members 10, the gas isolation means 7 was opened and continual heat treatment carried out.

The outer material of the gloves Ts and the glove inserts Ti of the glove parts T to have finished cooling were fully and firmly bonded and the obtained glove parts T had no deformation such as stretching.

Furthermore, concerning the glove parts T formed from the outer material of the gloves Ts and the glove inserts Ti in the same way, when heat treatment was continued for 120 seconds with the gas pressure inside the glove inserts Ti at 0.005 MPa (0.05 kg/cm$^2$), the outer material of the gloves Ts was fully stretched and, even after the air of the glove inserts Ti was removed, it was larger than the original size.

Furthermore, in the present embodiment, the glove manufacturing device of FIG. 8 of the previous third mode for carrying out the invention was used, the fixing of the glove parts T to have had air injected in the glove inserts Ti to the glove holding members 3 was provided in advance, and, as heat treatment etc was carried out using the device of FIG. 9 of the fourth mode for carrying out the invention, productivity was better in comparison to the previous embodiments.

Furthermore, in this embodiment, the device of FIG. 8 was used and, although the fixing of the glove parts T to have had air injected in the glove inserts Ti to the glove holding members 3 was provided in advance, if using the method of the fourth mode of carrying out the invention, if nothing had been provided in advance by using the device of FIG. 8, and the glove inserts Ti and the outer material of the gloves Ts were adhered just by using the device of FIG. 9, it goes without saying that the control of the deformation due to stretching of the obtained outer material of the gloves Ts and the stabilisation and adhesion of the glove inserts Ti and the outer material of the gloves Ts could be achieved.

INDUSTRIAL APPLICABILITY

According to the present invention, the glove insert expands due to the injection of gas, the glove insert is bonded to the outer material of the glove, and the adhesive bonds by intervening between the outer material of the glove and the glove insert. Consequently, with just the expansion of the glove insert by means of gas, it is possible for the variation in bonding to be controlled and the glove can be finished in an appropriate form. Furthermore, there is a relatively simple device for injecting gas and, by use of a turntable, by conveying the glove parts to have the glove insert inserted in the outer material of the glove to the heating furnace arranged at a designated position at the turntable and softening or melting the thermoplastic adhesive, it is possible to plan a gain in efficiency with regards to the adhesion operation of the glove insert to the inner side of the outer material of the glove and to plan an increase in productivity.

The invention claimed is:

1. A glove manufacturing device to adhere a glove insert to an inner side of an outer material of a glove, the glove manufacturing device comprising:

a glove holding member that holds the glove parts in a state when the glove insert has been inserted in the inner side of the outer material of the glove;

a heating furnace configured to apply heat to the glove;

a turntable coupled to the glove holding member and configured to rotate the glove holding member between an inlet/outlet and the heating furnace, wherein the inlet/outlet is outside the heating furnace;

a gas injection means to inject gas in the glove insert, wherein the gas injection means is configured to inject gas in the glove insert when the glove insert is at the inlet/outlet and when the glove insert is in the heating furnace.

2. The glove manufacturing device of claim 1, wherein the glove holding member has a hollow internal passageway, and the gas injection means is connected to the glove holding member.

3. The glove manufacturing device of claim 1, wherein the glove holding member has a gas isolation means to control an outward flow of gas.

4. The glove manufacturing device of claim 1, wherein a pressure regulation means is connected to the glove holding member in order to prevent pressure of the gas injected in the glove insert from increasing over a certain value.

5. The glove manufacturing device of claim 1, wherein the glove holding member is fixed on the turntable so that the glove holding member can be attached and detached at will.

6. The glove manufacturing device of claim 1, wherein the turntable is configured to maintain the glove holding member in the heating furnace for a designated duration to carry out heat treatment, and then return the glove holding member to the inlet/outlet.

7. The manufacturing device of claim 1, further comprising a coupling member which has a valve mechanism that couples the glove holding member to the gas injection means.

8. The glove manufacturing device of claim 1, wherein the gas injection means is configured to inject gas into the glove insert to provide a first pressure while the glove holding member is outside the heating furnace, and to inject additional gas into the glove insert while the glove holding member is in the heating furnace to provide a second pressure that is higher than the first pressure.

9. The glove manufacturing device of claim 1, wherein the turntable is further configured to rotate the glove holding member to a preheating chamber and to a cooling chamber.

10. The glove manufacturing device of claim 9, wherein, as the turntable rotates, the glove holding member passes from the inlet/outlet to the preheating chamber, then to the heating furnace, then to the cooling chamber, and then back to the inlet/outlet.

11. The glove manufacturing device of claim 1, wherein the glove holding member is a first glove holding member, and wherein the glove manufacturing device includes a plurality of glove holding members, including the first glove holding member, coupled to the turntable.

* * * * *